US010975632B2

(12) United States Patent
Martinsen et al.

(10) Patent No.: US 10,975,632 B2
(45) Date of Patent: Apr. 13, 2021

(54) DEPTH COMPENSATED ACTUATOR AND USE OF SAME IN ASSOCIATION WITH A TRANSPORTABLE HEAVE COMPENSATOR

(71) Applicant: SAFELINK AS, Skien (NO)

(72) Inventors: Tord B Martinsen, Skien (NO); Andre Skare Berg, Skien (NO)

(73) Assignee: SAFELINK AS, Skien (NO)

( * ) Notice: Subject to any disclaimer, the term of this patent is extended or adjusted under 35 U.S.C. 154(b) by 136 days.

(21) Appl. No.: 16/099,634

(22) PCT Filed: May 8, 2017

(86) PCT No.: PCT/NO2017/050111
§ 371 (c)(1),
(2) Date: Nov. 7, 2018

(87) PCT Pub. No.: WO2017/196181
PCT Pub. Date: Nov. 16, 2017

(65) Prior Publication Data

US 2019/0145191 A1 May 16, 2019

(30) Foreign Application Priority Data

| | | |
|---|---|---|
| May 8, 2016 | (NO) | 20160773 |
| Jul. 7, 2016 | (NO) | 20161135 |
| Dec. 17, 2016 | (NO) | 20162010 |

(51) Int. Cl.
*E21B 19/08* (2006.01)
*E21B 19/00* (2006.01)
(Continued)

(52) U.S. Cl.
CPC ..... *E21B 19/006* (2013.01); *B66C 13/04* (2013.01); *F15B 21/006* (2013.01)

(58) Field of Classification Search
CPC ..... E21B 19/006; B66C 13/04; F15B 21/006
(Continued)

(56) References Cited

U.S. PATENT DOCUMENTS

| | | | |
|---|---|---|---|
| 3,643,751 | A | 2/1972 | Crickmer |
| 3,912,227 | A | 10/1975 | Meeker et al. |

(Continued)

FOREIGN PATENT DOCUMENTS

| | | | |
|---|---|---|---|
| CN | 101865239 | A | 10/2010 |
| CN | 102575503 | A | 7/2012 |

(Continued)

OTHER PUBLICATIONS

Office Action dated Nov. 21, 2019 received in corresponding Chinese application No. 201780028271.X, (8 pages) and English translation (12 pages).

(Continued)

*Primary Examiner* — Matthew R Buck
*Assistant Examiner* — Patrick F Lambe
(74) *Attorney, Agent, or Firm* — Foley & Lardner LLP

(57) ABSTRACT

The publication relates to a depth compensated actuator, for a transportable inline depth compensated heave com-pensator for subsea lifting operations. The actuator comprises a cylinder shaped body and a piston with a piston rod, the piston rod being intended for exposure to external water pressure, a first and second connection means associated with the actuator. Further, the actuator comprises a depth compensator comprising a cylinder, a piston and a piston rod, the end of which being exposed to surrounding water; and conduit means between at least one volume in the actuator and one volume in the depth compensator. The pistons and piston rods are shaped as any of: hollow piston rod, ring shaped piston, ring piston rod. The depth compensated actuator solves the problem if improving depth com- (Continued)

pensation performance regarding size, weight, required fluid consumption, internal/inherent friction and adaptability. Further, use of a depth compensated actuator is claimed.

2 Claims, 3 Drawing Sheets

(51) Int. Cl.
*B66C 13/04* (2006.01)
*F15B 21/00* (2006.01)

(58) Field of Classification Search
USPC ..... 166/355
See application file for complete search history.

(56) References Cited

U.S. PATENT DOCUMENTS

| | | | | |
|---|---|---|---|---|
| 4,724,970 | A | 2/1988 | Kuhn | |
| 4,964,491 | A | 10/1990 | Dombrowski et al. | |
| 7,980,787 | B1 * | 7/2011 | Trent | E21B 19/002 166/355 |
| 9,038,433 | B2 | 5/2015 | Skjetne et al. | |
| 9,097,267 | B2 | 8/2015 | Eide et al. | |
| 9,611,185 | B2 | 4/2017 | Henck | |
| 10,495,073 | B2 | 12/2019 | Tucker et al. | |
| 2008/0251980 | A1 * | 10/2008 | Ormond | F15B 21/006 267/125 |
| 2015/0354604 | A1 | 12/2015 | Froehlich et al. | |
| 2016/0138357 | A1 | 5/2016 | Bauer et al. | |

FOREIGN PATENT DOCUMENTS

| | | | |
|---|---|---|---|
| CN | 103080544 | A | 5/2013 |
| CN | 103147973 | A | 6/2013 |
| CN | 103188904 | A | 7/2013 |
| CN | 105473808 | A | 4/2016 |
| CN | 105556130 | A | 5/2016 |
| DE | 10 2014 215 313 | A1 | 2/2016 |
| WO | WO-2009/126711 | A1 | 10/2009 |
| WO | WO-2016/122321 | A1 | 8/2016 |

OTHER PUBLICATIONS

International Search Report dated Aug. 16, 2017 in PCT International Application No. PCT/N02017/050111, 5 pages.
Written Opinion of the International Searching Authority dated Aug. 16, 2017 in PCT International Application No. PCT/N02017/050111, 6 pages.
Search Report dated Feb. 3, 2017 received in corresponding Norwegian application No. 20161135, 2 pages.
Search Report dated Jun. 30, 2017 received in corresponding Norwegian application No. 20162010, 2 pages.
Search Report dated Nov. 3, 2016 received in corresponding Norwegian application No. 20160773, 2 pages.

* cited by examiner

PRIOR ART

DEPTH COMPENSATED ACTUATOR AND USE OF SAME IN ASSOCIATION WITH A TRANSPORTABLE HEAVE COMPENSATOR

CROSS REFERENCE TO RELATED APPLICATIONS

The present application is a National Stage of International Application No. PCT/NO2017/050111 filed on May 8, 2017, which claims the benefit of Norwegian Patent Application Nos. 20160773 filed on May 8, 2016, 20161135 filed on Jul. 7, 2016 and 20162010 filed on Dec. 17, 2016. The entire disclosures of all of which are incorporated herein by reference.

TECHNICAL FIELD OF THE INVENTION

The present invention relates to a depth compensated actuator intended for subsea use, compensating for variation in appearing water pressure. Moreover, the invention relates to a depth compensated actuator suitable for subsea lifting operations, comprising an actuator comprising a cylinder-shaped body and a piston with a piston rod, able to reciprocate inside the cylinder, connection means associated with the cylinder, the heave compensator also comprises volumes intended to contain a fluid, and with an arrangement provided with surface intended to be exposed to external water pressure effect.

BACKGROUND OF THE INVENTION

Prior art depth compensated actuators do exist. US 2008/0251980 A1 relates to a depth compensated passive heave compensator. This prior art heave compensator consists of three major components: an actuator device; an accumulator and a depth compensator. The actuator consists of a first cylinder provided with a piston and piston rod, the first cylinder being connected directly or by means of a crane at its upper end to a vessel. The piston rod extends from a piston located within the first cylinder through the lower end thereof and is connected to subsea equipment or a payload to be lifted or lowered. The accumulator consists of a second cylinder containing a movable piston, while the depth compensator consists of a third cylinder containing a movable piston and a piston rod, the piston rod extending down through the lower end of the cylinder and is provided with a surface exposed to the surrounding water pressure. The upper volume of the actuator is in fluid communication with the upper volume of depth compensator, while the lower volume of the actuator is in fluid communication with the volume beneath the piston of the accumulator. When exposed to increasing water pressure due to increasing water depths, the external water pressure will act on the free surface of the exposed piston rod of the third cylinder, forcing the piston upwards, forcing the liquid above the piston out of the third cylinder and into the upper volume of the first cylinder, affecting the position of the actuator piston. When the external water pressure decreases, the opposite effect will occur. In such manner, the effect of the external pressure on the heave compensator is eliminated or at least mitigated.

The prior art compensation is performed utilizing a pressure intensifier principle in the form of an external cylinder to compensate the effect of the water pressure acting on the piston rod. This requires a second hydraulic cylinder the depth compensator) connected to the main hydraulic cylinder (actuator). Compared to embodiments of the present invention, the main disadvantages of the prior art are:

larger space requirement
larger weight
larger friction
lack of free pressure surface for active piston rod control.

SUMMARY OF THE INVENTION

The main difference between the prior art and the compensators according to the present invention is the way and manner the depth compensation is obtained, as well as the possibility of using active rod control. According to the present invention different ways and devices for providing depth compensating devices intended to be integrated with an actuator are provided.

In general, the actuator the depth compensator and the accumulator comprise cylinders, pistons and integrated piston rods fixed to the pistons, the pistons being movably arranged inside the respective cylinder, while at least one end of the depth compensator rod extends out through an end closure of the cylinder, the free end of the rod having a surface, exposed to the surrounding water pressure.

According to the invention various embodiments, both of actuator and depth compensators, are provided and may be combined and configured in a suitable manner and, all within the inventive concept of the invention, to obtain efficient and effective combinations, forming integrated, slender and efficient units, for example suitable for use as a subsea heave compensator.

In the disclosure below high pressure means pressures up to 500 bar or more, while low pressure or vacuum means pressures below 2 bar.

An object of the present invention is to provide a depth compensated actuator where the overall size, slenderness, and/or weight of the compensator, such as the added weight of the compensation cylinder and possible pressure intensifier devices required and volume of required hydraulic fluid are significantly reduced compared with the prior art compensators.

Another object of the invention is to provide a system with reduced inherent friction in the system, i.e. friction for example caused by hydraulic seals and/or transfer of fluid in the system, and friction and added inertia of the moving parts of the compensator.

Another object of the invention is to provide an actuator with a free pressure area that can be utilized as part of an active heave compensator.

Yet another object of the invention is to develop and improve the actuator and/or the depth compensator unit configuration to significantly reduce the required size and weight of the unit, limiting the size of working volumes that must be filled with oil, without reducing the capacity or efficiency of the system. Friction is also smaller as the seal size is significantly reduced.

A further object of the invention is to provide embodiments of different types of depth compensated actuators, suitable to be used as an integrated part of a heave compensator.

The main features of the present invention are given in the independent claim. Additional features of the invention are given in the dependent claims.

According to the invention it is provided a depth compensated actuator, suitable to form a part for example of a transportable inline depth compensated heave compensator for subsea lifting or loading operations, comprising an actuator that comprises a cylinder shaped body and a piston with a piston rod, able to reciprocate inside the cylinder shaped body, a first and second connection means associated with the actuator, the actuator also comprises volumes intended to contain a gas or a liquid. The tail surface associated with the piston rod is intended to be exposed to external water pressure; a depth compensator comprising a cylinder, a piston and a piston rod extending out through an end closure of the depth compensator, the end of which being exposed to a surrounding water; and conduit means between at least one volume in the actuator (1,10) and one volume in the depth compensator. The actuator is a combination either of:

an actuator with a hollow piston rod configuration and a depth compensator chosen from the group of: depth compensator with a hollow piston rod;

compensator with a ring-shaped piston and piston rod; or a compensator with a cylinder, piston, and piston rod, a free end of which being exposed to external water pressure; or an actuator comprising a cylinder; piston; and piston rod; the free end of which being exposed to surrounding sea water, and a depth compensator in with a ring-shaped piston and piston rod.

According to one embodiment the conduit means may connect a volume in the hollow actuator piston rod and a volume in the hollow depth compensator piston rod.

The conduit means may connects the volume at the closed end of the actuator and the closed volume of the piston in the compensator, both opposite side of the piston rod.

The depth compensated actuator may be used in subsea conditions, and the actuator may be a high-pressure depth compensated actuator and comprises is a hollow rod actuator and where the depth compensating is:

a hollow rod actuator may consist of a first cylinder, a first piston, a first hollow rod, connection means at each axial end of the hollow rod actuator, a second cylinder mounted concentric with the first cylinder and fastened to the upper end of the first cylinder and a second piston, mounted at the lower end of the second cylinder;

a first volume V1 may be formed by the outer diameter of the hollow rod, the lower end of the first cylinder, the inner diameter of the first cylinder and the lower end of the first piston, and may be filled with oil, gas or be under vacuum;

a second volume V2 may be formed by the outer diameter of the second cylinder, the upper end of the first cylinder, the inner diameter of the first cylinder, the upper end of the first piston, the inner diameter of the first hollow rod and the upper end of the second piston and may be filled with oil, gas or be under vacuum;

a third volume V3 may be formed by the inner diameter of the second cylinder, the upper end of the first cylinder, the inner diameter of the hollow rod, the lower end of the second piston and the lower end of the hollow rod, and may be filled with oil, gas or be under vacuum;

a depth compensator, consisting of a third cylinder, a second hollow rod, a fourth cylinder mounted concentric with the third cylinder and fastened to the upper end of the third cylinder, a third piston mounted at the lower end of the fourth cylinder and a mechanical stroke limiter mounted at the upper end of the second hollow rod, preventing the second hollow rod from stroking excessively;

a fourth volume V4 volume may be formed between the lower end of the third cylinder, the inner diameter of the third cylinder, the outer diameter of the fourth cylinder, upper end of the third piston and displaced by the second hollow rod as well as the mechanical stroke limiter, which may be filled with gas or be under vacuum;

a fifth volume V5 may be formed between the lower end of the second hollow rod, the inner diameter of the fourth cylinder, the lower end of the second hollow rod, the upper end of the third cylinder and the lower end of the third piston, which may be filled with oil;

conduit means between the fifth volume V5 and the third volume V3.

According to another embodiment of the invention, the depth compensated actuator may be configured wherein the volume of the hollow piston rod of the actuator communicates with the volume in the hollow rod of the depth compensator through a stationary cylinder inside the actuator cylinder and a stationary cylinder inside the depth compensator cylinder.

The piston rod of the depth compensator may be ring shaped and may be provided with a stroke limiting device.

Moreover, the cylinder of the depth compensator is open downwards and that the inner diameter of the open-ended cylinder corresponds to outer diameter of the hollow piston rod.

In an embodiment, the cross-sectional area of the hollow piston of the depth compensator exposed to the surrounding water is larger than the corresponding exposed area of the actuator.

According to an embodiment of a depth compensated actuator, the actuator comprises:

a connection means and a second connection means that are connected to either a fixed or movable point, i.e. crane hook, payload, seabed, etc.;

a cylinder, with piston and piston rod;

a second cylinder is mounted concentrically on the upper part (the side with the first connection means), the second cylinder has a larger diameter than the first cylinder, but shorter length;

the second cylinder features a ring-shaped piston connected to a ring-shaped piston rod;

a conduit means connects the oil side of the ring-shaped cylinder and the cylinder together.

Said depth compensated actuator may further be configured in such way that the area ratio between the ring-shaped piston and the ring-shaped piston rod is equal to or smaller than the area ratio between the piston and the piston rod.

According to another embodiment of the depth compensated actuator, the actuator may comprise:

a hollow rod actuator, consisting of a first cylinder, a first ring piston, a hollow rod, connection means at each axial end of the hollow rod actuator and a second cylinder, mounted concentric with the first cylinder and fastened to the upper end of the cylinder;

the ring piston may be adapted to slide on the outer diameter of the second cylinder;

a first volume V1 may be formed by the outer diameter of the hollow rod, the lower end of the first cylinder, the inner diameter of the first cylinder and the ring piston, and may be filled with oil or gas;

a second volume V2 may be formed by the outer diameter of the second cylinder, the upper end of the first cylinder, the inner diameter of the first cylinder and the ring piston, and may be filled with oil, gas or be under vacuum;

a third volume V3 may be formed by the inner diameter of the second cylinder, the upper end of the first cylinder, the inner diameter of the hollow rod and the lower end of the hollow rod, and may be filled with oil, gas or be under vacuum;

a depth compensator is connected to either the second volume V2 or the third volume V3 via conduit means.

According to this embodiment, the depth compensator may further consist of a third cylinder; a piston exposed to external pressure; a piston rod connected to the piston and adapted for reciprocation inside the third cylinder; a fourth cylinder, mounted concentrically with the third cylinder at the lower end of the third cylinder; forming a fourth volume V4 between the lower end of the fourth cylinder, the inner diameter of the fourth cylinder, the lower end of the third cylinder and displaced by the piston rod, which may be filled with oil; forming a fifth V5 volume between the lower end of the third cylinder, the inner diameter of the third cylinder, lower end of the piston and the outer diameter of the piston rod, which may be filled with gas or be under vacuum; and conduit means between the fourth volume V4 and the third volume V3.

According to a variant of a hydraulically depth compensated actuator, the depth compensator may be a depth compensator further consist of a third cylinder; a piston; a piston rod exposed to external pressure connected to the piston and adapted for reciprocation inside the third cylinder; forming a fifth V5 volume between the lower end of the third cylinder, the inner diameter of the third cylinder, lower end of the piston and the outer diameter of the piston rod, which may be filled with gas or be under vacuum; forming a sixth volume V6 between the upper end of the third cylinder, the inner diameter of the third cylinder and the upper end of the piston which may be filled with oil; and a conduit means between the sixth volume V6 and the second volume V2.

As an option oil is replaced by any fluid and/or gas is replaced by any fluid and/or vacuum is replaced by any fluid/gas.

According to the present invention the depth compensated actuators may be used for active heave compensation by connected the actuator to a gas accumulator comprising the following elements:

a first accumulator cylinder;

a second accumulator cylinder having a smaller diameter than the first accumulator cylinder, a piston configured to reciprocate inside the first accumulator cylinder, dividing the first accumulator cylinder into a ninth volume V9 and a tenth volume V10, and a piston rod fixed to and projecting out from the piston, the opposite end of the piston rod being position inside the second accumulator cylinder, and a first conduit device for establishing fluid communication between volume V9 of the gas accumulator and volume V1 of the actuator; and a second conduit device for establishing fluid communication between accumulator volume V11 and the actuator volume V3, a reversible pump forming a part of the second conduit device.

According to another embodiment of the invention, it is provided a high-pressure depth compensated actuator (HPDCA) for subsea use, compensating for water pressure effects that often are problematic. The novel design of the HPDCA is use of a hollow rod actuator combined with a high-pressure depth compensator cylinder, to provide a light design with a minimum amount of friction while adding an extra pressure surface.

The HPDCA uses a hollow rod actuator to significantly reduce the required size and weight of the depth compensator as only the volume of the hollow piston must be filled with oil. Friction is also much smaller as the seal size is significantly reduced (from full actuator diameter to the inside diameter of the hollow piston rod). The required amount of oil flow is also significantly lower than for the prior art solutions.

According to a yet another embodiment of the invention it is provided a traditional actuator combined with a ring based depth compensation cylinder, all in one compact, symmetrical assembly. The ring based depth compensation cylinder is provided with a ring-shaped piston, reciprocating in a ring-shaped volume surrounding the traditional actuator, the ring-shaped piston being provided with a ring-shaped piston rod, fixed to the ring-shaped piston and extending out through the enclosure of the ring-shaped volume, the free end of which being exposed to the pressure of the surrounding sea water. This ensures that the water pressure effect is negated.

According to yet another embodiment of the invention it is provided a hydraulically depth compensated actuator, comprising a hollow rod actuator combined with various depth compensating cylinders, to provide an alternative design better suited for combination with active actuator rod control. Active actuator rod control is shown for one of the embodiments.

BRIEF DESCRIPTION OF THE DRAWINGS

In the following, schematic embodiments of the invention shall be described in further detail, showing only the major components involved, referring to the drawings, wherein.

DETAILED DESCRIPTION OF EMBODIMENTS DISCLOSED IN THE DRAWINGS

The following description of embodiments of the invention refers to the accompanying drawings. The same reference numbers in the different drawings identify the same or similar elements. Various volumes in the actuators and depth compensators are identified with V and a digit (V1, V2, . . . Vn) and volumes have the same function or position are given the same identification, independent of fluid to be contained in such volume. The following detailed description does not limit the invention. Instead, the scope of the invention is defined by the appended claims. The following embodiments are discussed, for simplicity, regarding the terminology and structure of actuators and depth compensators to be used for offshore lifting operations where the actuators and the depth compensators are forming part of a transportable, inline heave compensator to follow the payload subsea.

Reference throughout the specification to "one embodiment" or "an embodiment" means that a feature, structure or characteristics describing an embodiment included in at least one embodiment of the subject matter disclosed. Thus, the appearance of the phrases "in one embodiment" or "in an embodiment" in various places throughout the specification is not necessarily referring to the same embodiment. Further features, structures or characteristics may be combined in any suitable manner or in one or more embodiments. The same applies to whether a volume is filled with gas or a liquid.

It should also be appreciated that elements commonly associated with actuators or depth compensators are from a simplicity point of view not always disclosed or indicated. Typical elements associated with a system, such as seals, accumulators, other types of pressure intensifiers, pumps, valves, control systems are not disclosed in detail.

Figure 1:
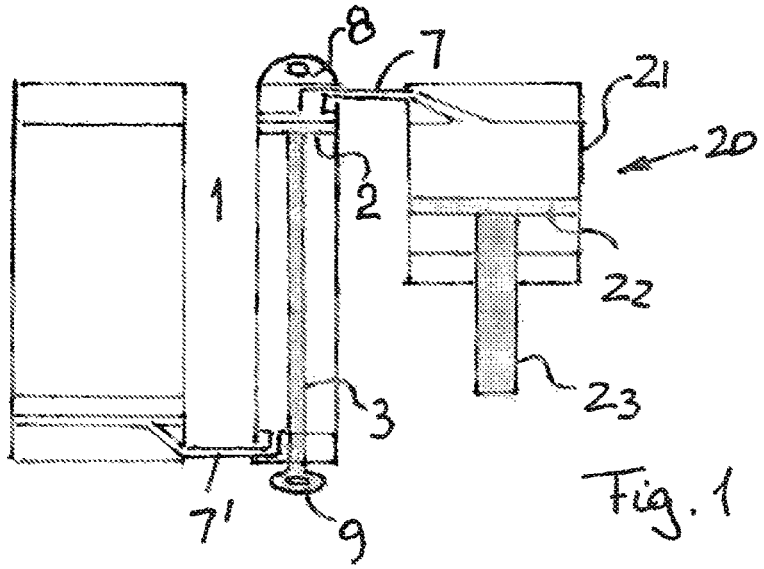
FIG. 1 discloses schematically an illustration of a prior art depth compensated actuator used as a heave compensator for subsea use.

FIG. 1 discloses schematically an illustration of a prior art depth compensated actuator 0 incorporated in a heave compensator for subsea use. The parts disclosed are a conventional actuator consisting of a cylinder, a piston 2 reciprocally arranged inside the cylinder 1 and a piston rod 3 rigidly fixed to the piston 2. The piston 2 establishes two different volumes in the cylinder 1. At its upper end the actuator 1 is provided with a first connection means 8 while the free end of the piston rod 3 is provided with a second connection means 9. The first connection means 8 is configured to be connected to a crane or the like (not shown), while the second connection means 9 is configured to be fixed to a payload (not shown) to be installed on the seabed.

Moreover, the actuator is fluidly communicating with a depth compensator 20, consisting of a cylinder 21 and a piston 22, reciprocally arranged inside the depth compensator 20. A piston rod 23 is fixed to the piston 22, the piston rod 23 extending out through the bottom closure of the cylinder 21, having an end surface exposed to the surrounding water pressure. The upper volume of the depth compensator is in fluid communication with the upper volume of the actuator.

The system disclosed in FIG. 1 also consist of a gas accumulator consisting of a cylinder and a piston reciprocally arranged inside the cylinder, splitting the cylinder into an upper and lower volume. The lower volume of the accumulator is in fluid communication with the lower volume of the actuator.

Figure 2:
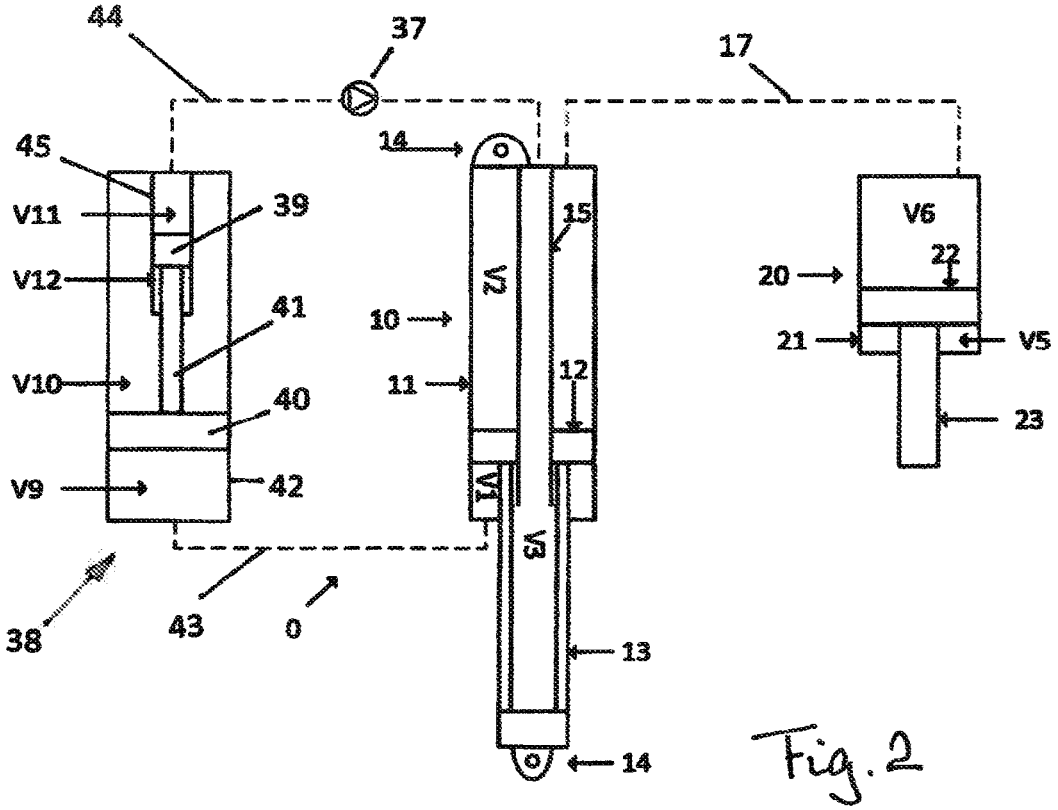
FIG. 2 discloses schematically an illustration of one embodiment of a depth compensated actuator according to the present invention, where it is forming a part of an active heave compensator.

FIG. 2 discloses schematically an illustration of one embodiment of a depth compensated actuator 0 according to the present invention wherein the depth compensated actuator 0 is forming a part of an active heave compensator, disclosing how to implement active control of the actuator rod, i.e. the active heave compensation. The depth compensated actuator 0 disclosed in FIG. 2 corresponds to the embodiment disclosed in FIG. 5, and will be described in further detail below. The following components are added compared to depth compensated actuator 0 disclosed in FIG. 5:

A reversible pump 37

A gas accumulator 38 with a first 39 and second piston 40.

An active heave compensator (AHC) comprises an actuator connected to one or more accumulators, which further may be connected to one or more gas tanks. The accumulator shown allows for very efficient use of commercially available hydraulic motors, used to gain active control the hydraulic actuator. Automatic control of the hydraulic actuator is used to compensate for heave motion. The automatic control is controlled by a computer that calculates the control signal based on measurements from several sensors, where the most important ones are the piston position sensor, the accelerometer and the wire rope speed sensor. Information about the wire rope speed is transferred to the compensator with wireless signals while the compensator is in air and with acoustic transmission while it is submerged. The compensator can operate in several different modes with variable stiffness and damping with or without active control of the hydraulic actuator and with or without active control of the pressure levels in the various gas volumes. The compensator is energy efficient, since the passive part of the compensator carries the entire load of the payload weight and the actively controlled hydraulic pumps only must compensate for gas compression effects and friction, which typically is about 15% of the force compared to static force. Energy regeneration is also used so that only friction and oil leakage and mechanical losses in the hydraulic pump contributes to the energy consumption. Further, acoustic communication subsea and wireless communication topside allows for control and monitoring of the compensator, on-board sensors allows the user to verify performance after a lift is concluded.

Such AHC has the following advantages compared to the prior art; mobile construction, lower cost for same capacity, as good performance for long wave periods and better performance for short wave periods, excellent splash zone crossing performance, well-suited for resonance protection, reduced wear of the steel wire rope, low energy consumption.

The following equations are used to design the accumulator, actuator and depth compensator (strength calculations not included and will influence the design somewhat, but those calculations depend on which design standard is being used to calculate strength). These equations are based on one pump, one actuator and one accumulator, but can easily be modified for multiple components of either type.

The main design criterions are:

Capacity of compensator ($F_{phc}$)

Actuator stroke length and compression ratio ($S_{act}$, c)

Speed of AHC system ($v_{ahc}$)

Actuator volume criterion

Force balance for depth compensator

Depth compensator volume criterion

The capacity of the compensator determines the size of the actuator piston and the actuator rod outer diameter (rod size indirectly calculated by strength calculations and actuator rod inner diameter) based on a design pressure.

$$F_{phc} = p_{phc}\frac{\pi}{4}(d_{act}^2 - d_{rod,o}^2)$$

where $F_{phc}$—Compensator capacity (max force)

$p_{phc}$—Actuator design pressure $d_{act}$—Inner diameter of actuator $d_{rod,o}$—Outer diameter of actuator rod The compression ratio determines the change in force as the actuator rod is extended due to compression of the gas in the system.

$$C = \frac{V_{max}}{V_{min}} = \frac{V_{tank} + V_{acc}}{V_{tank} + V_{acc} - \frac{\pi S_{act}}{4}(d_{act}^2 - d_{rod,o}^2)}$$

where

C—Compression ratio $V_{max}$—Gas volume at zero actuator stroke $V_{min}$—Gas volume at maximum actuator stroke $V_{tank}$—Gas volume of tanks $V_{acc}$—Gas volume of accumulator $S_{act}$—Actuator stroke length (max)

The minimum required force in the active part of the system to be able to compensate for gas compression effects is (factor 2 is due to that the AHC system can influence the actuator piston in two directions):

$$F_{ahc} = F_{phc}\left(\frac{C^{\kappa} - 1}{2}\right) = p_{ahc}\frac{\pi}{4}d_{rod,i}^2$$

$F_{ahc}$—Force that AHC can exert on the actuator piston (single direction)

$p_{ahc}$—Design pressure in AHC system $d_{rod,i}$—Inner diameter of actuator rod K—Adiabatic compression coefficient The size of the pump is related to the required actuator speed.

$$v_{ahc} = \frac{4Q_{pump}}{\pi d_{rod,i}^2}$$

where $v_{ahc}$—Speed of actuator rod under active control

Q—Pump volume flow

The oil volume of the passive part of the actuator must fit inside the accumulator.

$$(d_{act}^2 - d_{rod,o}^2)S_{act} < d_{acc}^2 S_{acc}$$

where $d_{acc}$—Accumulator diameter $S_{acc}$—Accumulator stroke length (max)

To balance flow of oil through the oil pump the following equation must be true:

$$\frac{(d_{act}^2 - d_{rod,o}^2)}{d_{acc}^2} = \frac{d_{acc,ahc}^2}{d_{rod,i}^2}$$

where $d_{acc,ahc}$—Accumulator smaller piston diameter

To balance the pressure from the seawater the following equation must be fulfilled:

$$\frac{d_{rod,o}^2}{d_{act}^2 - d_{rod,i}^2} = \frac{d_{rod,dc}^2}{d_{dc}^2}$$

where $d_{rod,dc}$—Diameter of depth compensator rod $d_{dc}$—Diameter of depth compensator cylinder The final criterion is to make sure that the depth compensator has enough oil available to compensate the full actuator stroke:

$$(d_{act}^2 - d_{rod,i}^2)S_{act} < d_{dc}^2 S_{dc}$$

where $S_{dc}$—Stroke of depth compensator

The gas accumulator 38 consists of up to four volumes; two pistons 39,40, interconnected by means of a common piston rod 41. According to the embodiment disclosed, the second piston 40 has a larger diameter than the first piston 39. The second piston 40 is reciprocally arranged in a cylinder 42 with a corresponding inner diameter as the second piston 40, the second piston 40 separating the cylinder 42 into a lower volume, the ninth volume, V9 and an upper volume V10 above the larger piston 40. Volume V9 is located between the lower end of the gas accumulator 38 and the large piston 40 and is filled with oil. The upper volume V10 is located between the upper surface of the large piston 40 and the upper end of the gas accumulator 38, and is filled with gas. Both larger and/or the smaller pistons may be provided with sealing devices (not shown).

A second cylinder 45 with a smaller diameter is concentrically arranged inside the larger cylinder 42, at the upper end of volume V10. The smaller piston 39 is intended to reciprocate inside the smaller cylinder 45. The inner diameter of the smaller cylinder 45 corresponds to the outer diameter of the smaller piston 39. The smaller piston 39 divides the volume of the smaller cylinder 45 into an upper, eleventh volume V11, placed between the upper surface of the piston 39 and the upper end of the gas accumulator 38, and a smaller, twelfth volume V12 below the lower surface of the smaller piston 39 and the bottom closure of the smaller cylinder 45. The lower closure or end of the smaller cylinder 45 is provided with a sealed opening in which the interconnecting piston rod 41 is reciprocating with the pistons 39,40. The eleventh volume V11 is filled with oil, while the twelfth volume V12 is normally under low pressure. The twelfth volume V12 is ring-shaped due to the volume of the interconnecting piston rod 41, and thus smaller than the volume V11.

According to the embodiment disclosed, volume V1 is connected to volume V9 through a conduit 43 providing the main passive force in the actuator 10. Volume V3 is connected to volume V11 via a conduit 44 with the reversible pump 37, providing active force on the actuator rod 13 in two directions.

The ring-shaped volume V12 formed between the outer surface of the common piston rod 41 and the inner surface of the smaller cylinder 45 may be separated or sealed from both volume V11 above the smaller piston 39 and the surrounding volume V10, forming a vacuum. Alternatively, as a first option, the volume V12 may be in fluid communication with the volume V11 inside the smaller cylinder 45 above the piston. In such case, the piston 39 may be removed, leaving only the piston rod 41 to reciprocate inside the smaller cylinder 45, the pressure exposed area then being reduced to the end surface of the piston rod 41. The volume V11 is then filled with oil. Yet second may be to allow the volume V12 to be in fluid communication with the surrounding volume V12, filled with gas. In such case the seals around the common piston rod 41 may be omitted.

A transportable heave compensator of this configuration may be substantially more simple, lighter, less cost related to construction, and a more robust and safer solution. Compared with the prior art solutions with same capacity, the overall weight may be decreased by around 10%, the cost by 10 to 15%, the risk for jamming of the piston is at least substantially reduced, if not eliminated. Moreover, and of importance: it may be possible to actively drive the actuator piston rod, due to the proposed configuration and the reversible pump.

Figure 3:
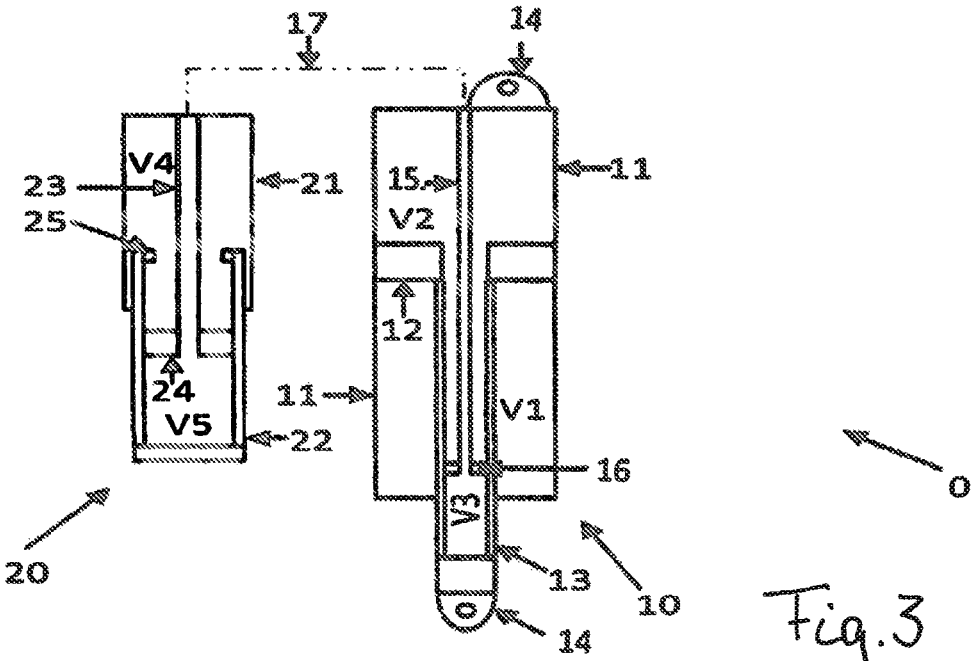
FIG. 3 discloses schematic an illustration of a high-pressure depth compensated actuator according to the present invention in which the major component parts of the high-pressure depth compensated actuator are specifically identified.

FIG. 3 relates to a high-pressure depth compensated actuator (HPDCA) is an actuator design intended for subsea usage. It compensates for water pressure effects that often are problematic.

The HPDCA uses a hollow rod actuator to significantly reduce the required size and weight of the depth compensator as only the volume of the inner tube must be filled with oil, comparted to the prior art solutions. Friction is also smaller as the seal size is significantly reduced (from full actuator diameter to rod inner diameter).

The main features of the present invention are given in the independent claim. Additional features of the invention are given in the dependent claims.

The novel design of the HPDCA is use of a hollow rod actuator combined with a high-pressure depth compensator cylinder, to provide a light design with a minimum amount of friction while adding an extra pressure surface.

As previously mentioned, FIG. 3 illustrates the HPDCA 0 with all the major sub-components numbered 1 through 25, as well as all volumes indicated by V1 through V5. In Table 1, the component description is identified. The HPDCA 0 can be used vertically, horizontally or at an angle. One application can be as an actuator for subsea valves operated at low pressure; another is as an actuator used at different water depths, typically as part of a heave compensator.

FIG. 3 shows the invention, details explained below:

- a hollow rod actuator 10, consisting of a first cylinder 11, a first piston 12, a first hollow piston rod 13, connection means 14 at each axial end of the hollow rod actuator 10, a second cylinder 15 mounted concentric with the first cylinder 11 and fastened to the upper end of the first cylinder 11 and a second, stationary piston 16 fixed to the lower end of the second cylinder 15
- a first volume V1 is formed between the outer diameter of the hollow rod 13, the lower end of the first cylinder 11, the inner diameter of the first cylinder 11 and the lower end of the first piston 12, and may be filled with oil, gas or be under vacuum
- a second volume V2 is formed by the outer diameter of the second cylinder 15, the upper end of the first cylinder 11, the inner diameter of the first cylinder 11, the upper end of the first piston 12, the inner diameter of the first hollow rod 13 and the upper end of the second piston 16 and may be filled with oil, gas or be under vacuum
- a third volume V3 is formed by the inner diameter of the second cylinder 15, the upper end of the first cylinder 11, the inner volume of the hollow rod 13, the lower end of the second piston 15 and the lower end of the hollow rod 13, and may be filled with oil, gas or be under vacuum. Normally, volume V3 is however, nearly always filled with oil and connected to volume V5. If the volume of oil in V5 is smaller than that of the volume V3 vacuum may arise.
- a depth compensator 20, consisting of a third cylinder 21, a second hollow rod 22, a fourth cylinder 23 mounted concentrically within the third cylinder 21 and fastened to the upper end of the third cylinder 21, a third, stationary piston 24 mounted at the lower end of the fourth cylinder 23 and a mechanical stroke limiter 25 mounted at the upper end of the second hollow rod 22, preventing the second hollow rod 22 from stroking too much, co-acting with the upper surface of the stationary piston 24
- a fourth volume V4 is formed between the upper surface of the stationary third piston 24 at the lower end of the third cylinder 21, the inner diameter of the third cylinder 21, the outer diameter of the fourth cylinder 23, and is displaced by the second hollow rod 22 as well as the mechanical stroke limiter 25, which may be filled with gas or be under vacuum
- a fifth volume V5 is formed between the lower end of the second hollow rod 22, the inner diameter of the fourth cylinder 23, the lower end of the second hollow rod 22, the upper end of the third cylinder 23 and the lower end of the third piston 24, which may be filled with oil
- conduit means 17 between the fifth volume V5 and the third volume V3.

The invention shown in FIG. 3 works in the following way:

Both hollow rods are exposed to external pressure.

The third volume and the fifth volume is connected through a conduit and will have the same pressure (internal pressure).

To negate external pressure influence on the first hollow rod, the internal pressure needs to be equal to the external pressure times the square of the ratio between the outer and inner diameter of the first hollow rod $$\left(p_{V3} = p_{ext} \cdot \left(\frac{d_o}{d_i}\right)^2\right).$$

A force balance gives:

$$F_{net} = p_{ext} \cdot \frac{\pi}{4} d_0^2 - p_{ext} \cdot \left(\frac{d_o}{d_i}\right)^2 \cdot \frac{\pi}{4} \cdot d_i^2 = 0$$

A second requirement is that the volume of the fifth volume is large enough to provide oil to the third volume for the entire usable stroke length.

To achieve these requirements, the diameter ratio between the outer and inner diameter of the second hollow rod needs to be the same as the ratio between the outer and inner diameter of the first hollow rod a $$\left(\frac{d_{o,1}}{d_{i,1}} = \frac{d_{o,2}}{d_{i,2}}\right),$$

second requirement is then that the inner diameter of the second hollow rod needs to be equal to the inner diameter of the first hollow rod times the square root of the ratio of the stroke length of the first hollow rod and the stroke length of the second hollow rod $$\left(d_{i,2} = d_{i,1} \cdot \sqrt{\frac{s_1}{s_2}}\right).$$

The first volume V1 can be used for passive heave compensation means by connecting it to a gas accumulator.

The second volume V2 is left unused and can be utilized as an extra pressure surface for active heave compensation purposes by connecting it to e.g. a pump.

The fourth volume V4 should normally be without pressure.

Figure 4:
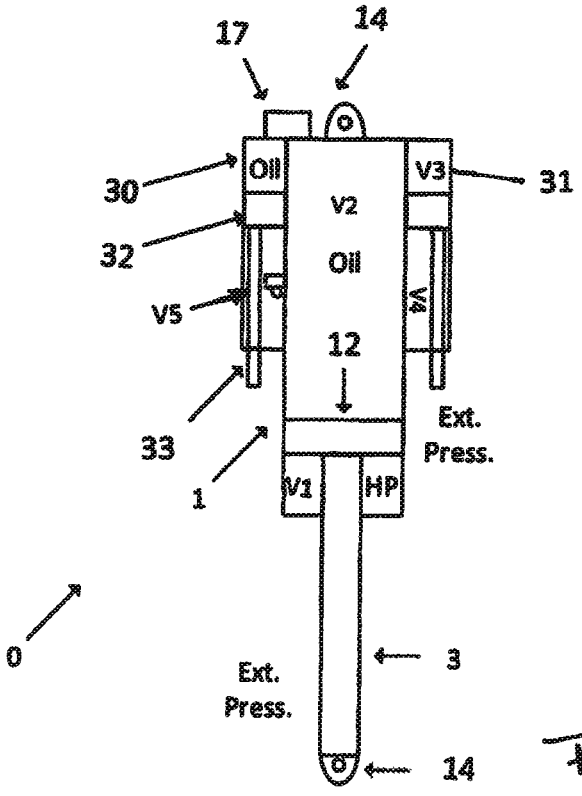
FIG. 4 discloses schematically an illustration of an embodiment of a compensated actuator according to the present invention in which the major component parts of the actuator are specifically identified.

FIG. 4 discloses an embodiment of a hydraulically compensated actuator (HCA) is an actuator design intended for subsea usage. It compensates for water pressure effects that often are problematic.

The novel design of the HCA is use of a traditional actuator combined with a ring based compensation cylinder, all in one compact, symmetrical assembly. The ring based compensation cylinder ensures that the water pressure effect is negated.

As previously mentioned, FIG. 4 illustrates the HCA (0) with all the major sub-components numbered as listed in the table below. The HCA 0 can be used vertically, horizontally or at an angle. One application can be as an actuator for subsea valves operated at low pressure; another is as an actuator used at different water depths, typically as part of a heave compensator. When used as a valve actuator the first connection means 14 and the second connection means 14 are connected to either a fixed or movable point. When used as part of a heave compensator, the first connection means 14 and the second connection means 14 are usually connected to the payload and/or the crane. The connection means 14 can be at least one of: a padeye and a clevis, but not limited only thereto. Further the HCA 0 consists of a cylinder 1, with piston 12 and piston rod 3. The piston 12 divides the cylinder into two volumes, V1, which is the volume below the piston 12 and housing the piston rod 3. A second cylinder 31 is mounted concentrically on the upper part, the volume having a general shape of an annulus (the top side with the first connection means 14, the second cylinder 31 has a larger diameter than the first cylinder 1, but shorter length. The second cylinder 31 features a ring-shaped piston 32 connected to a ring-shaped piston rod 33. The area ratio between the ring shaped piston 32 and the ring-shaped piston rod 33 is equal to or smaller than the area ration between the piston 12 and the piston rod 3. A conduit means 17 connects the oil side of the ring-shaped cylinder 31 and volume V2 in the cylinder 1 together, effectively cancelling the effect of the external pressure. The HP side of the cylinder 1 is connected to other hydraulics means, such as a piston accumulator or a HPU (not shown). The LP side of the ring-shaped cylinder 31 can be connected to other hydraulic means, such as a hydraulic pump in an active heave compensator, or be gas filled with low pressure gas.

The piston 32 divides the ring-shaped cylinder 31 into a ring shaped volume or annulus V3, while the ring-shaped piston rod 33 divides the volume below the piston into two concentrically arranged ring-formed volumes V4 and V5, where volume V4 is positioned between the outer wall surface of the centrally arranged volume V2 of the actuator cylinder 1, while volume V5 is arranged between the outer surface of the ring-shaped piston rod 33 and the inner surface of the outer concentrically arranged wall of the ring-shape cylinder 31. The area ratio between the ring-shaped piston 32 and the ring-shaped piston rod 33 is equal to or smaller than the area ratio between the piston 12 and the piston rod 3. Volume V1 contains a high-pressure fluid, while the volumes V4 and V5 contain a low-pressure fluid. Moreover, the various volumes have a cylindrical cross sectional. The high-pressure fluid may be oil, although also gas may be used instead.

To eliminate the effect of the surrounding water pressure, the correlation between the various volumes may be defined by the following equation:

$$\left(\frac{f}{e}\right)^2 = \frac{c^2 - d^2}{a^2 - b^2}$$

where a=the internal diameter of the outer ring-shaped cylinder 31 b=the inner diameter of the ring-shaped piston 32 c=the outer diameter of the ring-shaped piston rod 33 d=The inner diameter of the ring-shaped piston rod 33 f=the diameter of the piston rod 3 e=the diameter of the actuator cylinder 1, corresponding more or less to the diameter of the piston 12.

Moreover, in such case in order to use the full stroke of the actuator, the oil volume in the main cylinder and the ring-shaped cylinder must be equal.

A conduit means 17 connects the oil side of the ring-shaped cylinder 31 and volume V2 at the top of the cylinder 1 together, effectively cancelling the effect of external pressure. The HP side of the cylinder 1 is connected to other hydraulics, such as a piston accumulator or a HPU (not shown). The LP side of the ring-shaped cylinder 31 can be connected to other hydraulics, such as a hydraulic pump in an active heave compensator, or be gas filled with low pressure gas. The low-pressure volumes may not be exposed to any significant pressure, but a pressure may be used if it is desirable to active controlling the piston rod 3. In such case the volumes may be connected to a hydraulic pressure unit (HPU).

Figure 5:
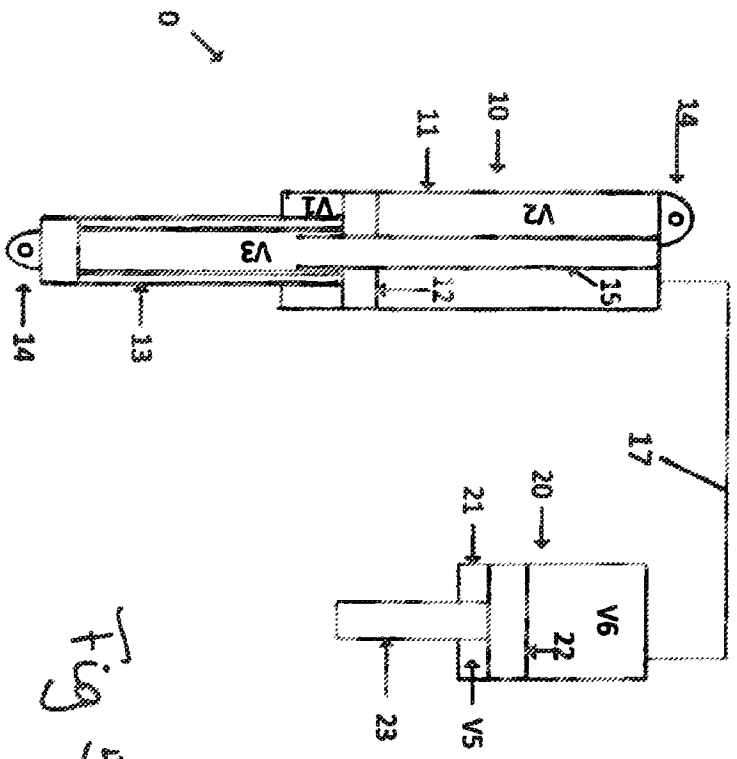
FIGS. 5 and 6 disclose schematic illustrations of various embodiment of a depth compensated actuator according to the present invention in which only the major component parts of the depth compensated actuator are specifically identified.
Figure 6:
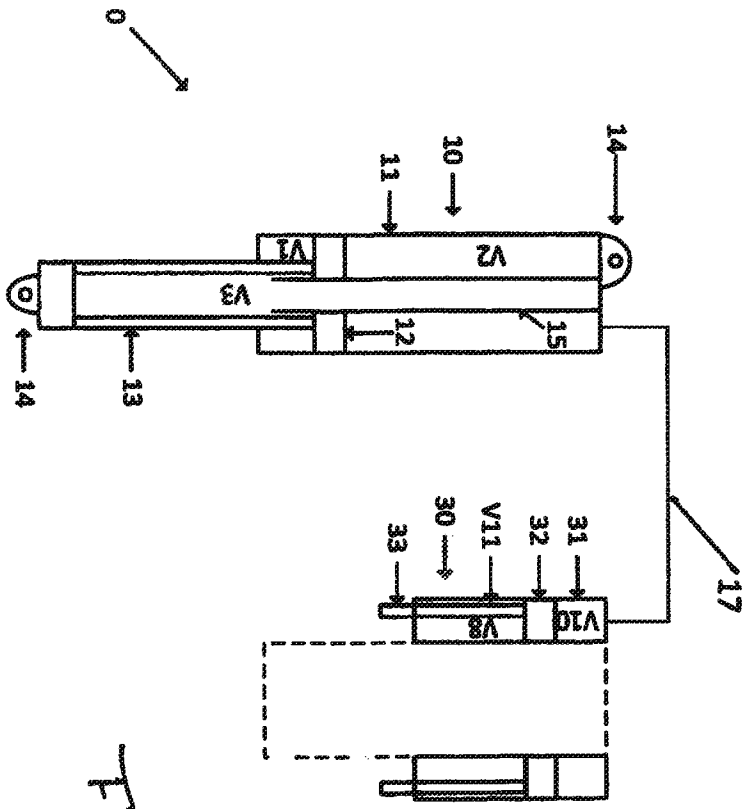

FIGS. 5 and 6 relate to a hydraulically depth compensated actuator (HDCA) is an actuator design intended for subsea usage. It compensates for water pressure effects that often are problematic.

The prior art compensation is performed utilizing an external cylinder to compensate the effect of the water pressure acting on the piston rod, thus requiring at least one large second hydraulic cylinder connected to the main hydraulic cylinder, while the present HCDA uses a hollow rod actuator to significantly reduce the required size and weight of the depth compensator as only the volume of the inner tube must be filled with oil. Friction is also much smaller as the seal size is significantly reduced (from full actuator diameter to inner tube diameter).

The novel design of the HDCA is use of a hollow rod actuator combined with various depth compensators cylinder, to provide a light design with a minimum amount of friction while adding an extra pressure surface.

As previously mentioned, FIG. 5 and FIG. 6 illustrate the HDCA 0 with all the major sub-components numbered 1 through 34, as well as all volumes indicated by V1 through V10. In Table 1, the component description is identified. If the volume V1 is fluidly connected to an accumulator, the fluid will always be oil. The hydraulically depth compensated actuator (HDCA) 0 can be used vertically, horizontally or at an angle. One application can be as an actuator for subsea valves operated at low pressure; another is as an actuator used at different water depths, typically as part of a heave compensator.

The two HDCA-embodiments shown has the following in common:

a hollow rod actuator 10, consisting of a first cylinder 11, a first ring piston 12, a hollow rod 13, connection means 14 at each axial end of the hollow rod actuator 10 and a second cylinder 15, mounted concentric with the first cylinder 11 and fastened to the upper end of the cylinder 11 a ring piston 12 adapted to slide on the outer diameter of the second cylinder 15 a first volume V1 is formed by the outer diameter of the hollow rod 13, the lower end of the first cylinder 11, the inner diameter of the first cylinder 11 and the ring piston 12 and may be filled with oil or gas a second volume V2 is formed by the outer diameter of the second cylinder 15, the upper end of the first cylinder 11, the inner diameter of the first cylinder 11 and the ring piston 12, and may be filled with oil, gas or be under vacuum a third volume V3 is formed by the inner diameter of the second cylinder 15, the upper end of the first cylinder 11, the inner diameter of the hollow rod 13 and the lower end of the hollow rod 13, and may be filled with oil, gas or be under vacuum a depth compensation means is connected to either the second volume V2 via conduit means.

FIG. 5 shows the first embodiment which in addition to the common parts contain:

a third cylinder 21 a piston rod 23 connected to the piston 22, where the piston 22 is exposed to external pressure, and both are adapted for reciprocation inside the third cylinder 21 a fourth cylinder 24, mounted concentrically with the third cylinder 24 at the lower end of the third cylinder 21 a fourth volume V4 is formed between the lower end of the fourth cylinder 24, the inner diameter of the fourth cylinder 24, the lower end of the third cylinder 21 and displaced by the piston rod 23, which may be filled with oil a fifth V5 volume is formed between the lower end of the third cylinder 21, the inner diameter of the third cylinder 21, lower end of the piston 22 and the outer diameter of the piston rod 23, which may be filled with gas or be under vacuum conduit means between the fourth volume V4 and the third volume V3.

FIG. 6 shows the second embodiment which in addition to the common parts contains:

a fifth cylinder (31)

a second ring piston (32), adapted for sliding motion of the outside diameter of any cylinder (shown with dashed line in FIG. 4) adapted for reciprocation inside the fifth cylinder (31)

a ring piston rod (33) connected to the ring piston (32), exposed to external pressure and adapted 20 for reciprocation inside the fifth cylinder (31)

an eighth volume (V8) is formed between the lower end of the fifth cylinder (31), the inner diameter of the ring piston rod (33) and the second ring piston (32), which may be filled with gas or be under vacuum a ninth volume (V9) is formed between the lower end of the fifth cylinder (31), the outer diameter 25 of the ring piston rod (33), the inner diameter of the fifth cylinder (31) and the second ring piston (32), which may be filled with gas or be under vacuum a tenth (V10) volume is formed between the upper end of the fifth cylinder (35), the upper end of the second ring piston (32), the inner diameter of the fifth cylinder (31), which may be filled with oil 30 conduit means between the tenth volume (V10) and the second volume (V2)

Many possible combinations exist when it comes to various fluids in the various volumes shown in the four embodiments.

TABLE 1

| Component | Description |
|---|---|
| 0 | Depth compensated actuator |
| 1 | Cylinder-prior art |
| 2 | Piston-prior art |
| 3 | Piston rod-prior art |
| 7 | Conduit means |
| 7' | Conduit means between actuator and accumulator |
| 8 | First connection means-prior art |
| 9 | Second connection means-prior art |
| 10 | Hollow rod actuator |
| 11 | First cylinder |
| 12 | Piston |
| 13 | Hollow piston rod |
| 14 | Connection means |
| 15 | Second cylinder |
| 17 | Conduit |
| 20 | Depth compensator |
| 21 | Third cylinder |
| 22 | Piston |
| 23 | Piston rod |
| 24 | Fourth cylinder |
| 30 | Ring based depth compensator |
| 31 | Fifth cylinder |
| 32 | Second ring piston |
| 33 | Second ring piston rod |
| 34 | Sixth cylinder |
| 35 | Gas accumulator |
| 36 | Gas accumulator piston |
| 37 | Reversible pump |
| 38 | Gas accumulator |
| 39 | First piston |
| 40 | Second piston |
| 41 | Common piston rod |
| 42 | Large cylinder |
| 43 | Conduit between V9 and V1 |
| 44 | Conduit between volume V3 and V11, incorporating the pump 37 |
| 45 | The smaller cylinder |
| V1 | First volume |
| V2 | Second volume |
| V3 | Third volume |
| V4 | Fourth volume |
| V5 | Fifth volume |
| V6 | Sixth volume |
| V7 | Seventh volume |
| V8 | Eighth Volume |
| V9 | Ninth volume |
| V10 | Tenth volume |
| V11 | Eleventh volume |
| V12 | Twelfth volume |

The invention claimed is:

1. A hydraulic depth compensated actuator, suitable to form a part, for example, of a transportable inline depth compensated heave compensator for subsea lifting or loading operations, the hydraulic depth compensated actuator comprising:

an actuator, the actuator comprising a first cylinder, a second cylinder mounted concentric with the first cylinder, and connected to the first cylinder at an upper end of the first cylinder, a ring piston configured to slide on the outer diameter of the second cylinder, a hollow piston rod connected to the ring piston and configured to reciprocate inside the first cylinder, wherein the hollow piston rod comprises a tail surface configured to be exposed to external water pressure, a first connection means and second connection means associated with the actuator such that first connection means is positioned at an axial end of the actuator and second connection means is positioned at an opposing axial end of the actuator, and a plurality of actuator volumes configured to contain a gas or a liquid, the plurality of actuator volumes including a first volume formed by an outer diameter surface of the hollow piston rod, a lower end surface of the first cylinder, an inner diameter surface of the first cylinder, and a lower end surface of the ring piston, wherein the first volume is configured to be filled with oil or gas, a second volume formed by an outer diameter surface of the second cylinder, an upper end surface of the first cylinder, the inner diameter surface of the first cylinder, and an upper end surface of the ring piston, wherein the second volume is configured to be filled with oil or gas or under vacuum, and a third volume formed by an inner diameter surface of the second cylinder, the upper end surface of the first cylinder, an inner diameter surface of the hollow piston rod, and a lower end surface of the hollow piston rod, wherein the third volume is configured to be filled with oil or gas or under vacuum; and a depth compensator, the depth compensator comprising a third cylinder, a second piston, a second piston rod extending out through an end closure of the depth compensator, wherein an end of the second piston rod is configured to be exposed to a surrounding water, and a plurality of depth compensator volumes, the plurality of depth compensator volumes including a fifth volume formed by a lower end surface of the third cylinder, an inner diameter surface of the third cylinder, a lower end surface of the second piston, and an outer diameter surface of the second piston rod, wherein the fifth volume is configured to be filled with gas or under vacuum, and a sixth volume formed by an upper end surface of the third cylinder, the inner diameter surface of the third cylinder, and an upper end surface of the second piston, wherein the sixth volume is configured to be filled with oil; and a conduit configured to connect the second volume in the actuator and the sixth volume in the depth compensator.

2. The hydraulic depth compensated actuator according to claim 1, wherein the hydraulic depth compensated actuator further comprises a depth compensator, the depth compensator comprising:

a first accumulator cylinder, a second accumulator cylinder having a smaller diameter than the first accumulator cylinder, and concentrically arranged inside the first accumulator cylinder at one end of the first accumulator cylinder, an accumulator piston configured to reciprocate inside the first accumulator cylinder, and dividing the first accumulator cylinder into a ninth volume at a side of the first accumulator piston and a tenth volume at an opposite side of the first accumulator piston, and an accumulator piston rod fixed to and projecting out from the accumulator piston, a second accumulator piston connected to an opposite end of the accumulator piston rod, wherein the second accumulator piston is positioned inside the second accumulator cylinder, and a first conduit configured to establish fluid communication between the ninth volume and at least one of the plurality of actuator volumes, a second conduit configured to establish fluid communication between the tenth volume and a separate one of the plurality of actuator volumes, and a reversible pump configured to be positioned along the second conduit.

* * * * *